US005816416A

United States Patent [19]

Tsai

[11] Patent Number: 5,816,416

[45] Date of Patent: Oct. 6, 1998

[54] SHAPE-CHANGEABLE SECTIONAL PENHOLDER

[76] Inventor: Szu-Hen Tsai, 2F, No. 12, Alley 1, Lane 171, Kuen Yang Street, Nan Kang Chiu, Taipei, Taiwan

[21] Appl. No.: 676,461

[22] Filed: Jul. 8, 1996

[51] Int. Cl.[6] ..... A47F 5/00

[52] U.S. Cl. ..... 211/69.1; 211/189; D19/84; D19/85

[58] Field of Search ..... 211/69.1, 194, 211/189; D19/81, 82, 84, 85

[56] References Cited

U.S. PATENT DOCUMENTS

| | | | |
|---|---|---|---|
| D. 214,768 | 7/1969 | Hillis | D19/85 X |
| D. 310,244 | 8/1990 | Evenson | D19/85 |
| D. 327,093 | 6/1992 | Evenson | D19/85 |
| 3,471,032 | 10/1969 | Thompson | 211/69.1 |
| 4,494,660 | 1/1985 | Hansen | 211/69.1 |
| 5,082,119 | 1/1992 | Bingley | 211/69.1 X |

*Primary Examiner*—Robert W. Gibson, Jr.
*Attorney, Agent, or Firm*—Morton J. Rosenberg; David I. Klein; Jun Y. Lee

[57] ABSTRACT

Disclosed is a shape-chageable sectional penholder assembled from a base, a middle panel, a plurality of brick elements, and a cover. The middle panel is formed at two faces with a plurality of projected rods. The rods on a first face of the middle panel form a circle and the rods on a second face of the middle panel form a square. The base is an octagonal hollow body with a closed bottom and is provided at every other top edges with a plurality of projected rods corresponding to through holes formed on the middle panel, such that the base is connected to the middle panel by engaging the projected rods with the through holes. The brick elements can be superposed on the projected rods of the middle panel and the projected rods of the base projecting from the through hole of the middle panel and on themselves to a desired or suitable height, such that a round, a square, or an octagonal sectional penholder can be formed.

6 Claims, 13 Drawing Sheets

PRIOR ART FIG. 2

SHAPE-CHANGEABLE SECTIONAL PENHOLDER

BACKGROUND OF THE INVENTION

There are many different types of penholders available in the markets. These penholders have, however, only one single function, that is, to receive the pens and the like therein. FIG. 1 illustrates an example of such conventional penholders.

To give the conventional penholders added functions, there is developed a sectional penholder, as shown in FIG. 2. This type of penholder includes a base A, a plurality of brick elements B, and a top cover C. The base A is provided around a periphery with a plurality of projected rods Al with which the brick elements B can be engaged. The base A has a predetermined fixed shape which defines the shape of the penholder assembled from the brick elements B, such as a round, a triangular, a square, or a polygonal penholder. The brick elements B are superposed on the base A and on themselves one by one to finally form a hollow container. The top cover C is closed to the hollow container formed from the brick elements to complete the sectional penholder. Such sectional penholder is different from the conventional penholder K as shown in FIG. 1 mainly in the brick elements B which may have different colors to provide changeable designs on the penholder.

However, such sectional penholder has the following disadvantages:

1. The base A has fixed shape and the projected rods Al thereof define a fixed configuration, too. Therefore, the brick elements B can only construct a penholder of fixed shape based on the base A and the projected rods Al.

2. The brick elements B are provided at a certain fixed quantity and there might be unused brick elements when a low penholder is formed. These unused brick elements B are usually put into the penholder along with pens for temporary storage and therefore cause some disorders in the penholder.

SUMMARY OF THE INVENTION

It is therefore a primary object of the present invention to provide an improved shape-changeable sectional penholder having an octagonal base and a middle panel. The base is provided on every other top edges with a plurality of projected rods and the middle panel are also provided at two faces with a plurality of projected rods. The projected rods on the first face of the middle panel define a circle and on the second face a square. On these projected rods, brick elements can be superposed layer by layer to a desired height and form a round or a square side wall for the penholder depending on which face of the middle panel is used. The middle panel is also formed with through holes in number and at positions corresponding to that of the projected rods on the base, so that the base can be engaged with the middle panel by extending its projected rods through the through holes of the middle panel to project therefrom. The rods of the base projected from the middle panel again allow the brick elements to be superposed thereon layer by layer to form an octagonal side wall for the penholder.

Another object of the present invention is to provide the above improved shape-changeable sectional penholder in which a space for containing unused brick elements is formed between the base and the middle panel so that the unused brick elements will not cause disorders or be carelessly discarded.

A further object of the present invention is to provide the above improved shape-changeable sectional penholder in which the middle panel is formed on two faces at central areas with a plurality of projected rods. On these central projected rods, the brick elements can be freely superposed to form any desired shape and be used as a unique desktop ornament.

BRIEF DESCRIPTION OF THE DRAWINGS

The special structure and the technical means adopted by the present invention to achieve the above objects can be best understood from the following detailed description of the preferred embodiments and the accompanying drawings, wherein.

DETAILED DESCRIPTION OF THE PREFERRED EMBODIMENTS

Figure 1:
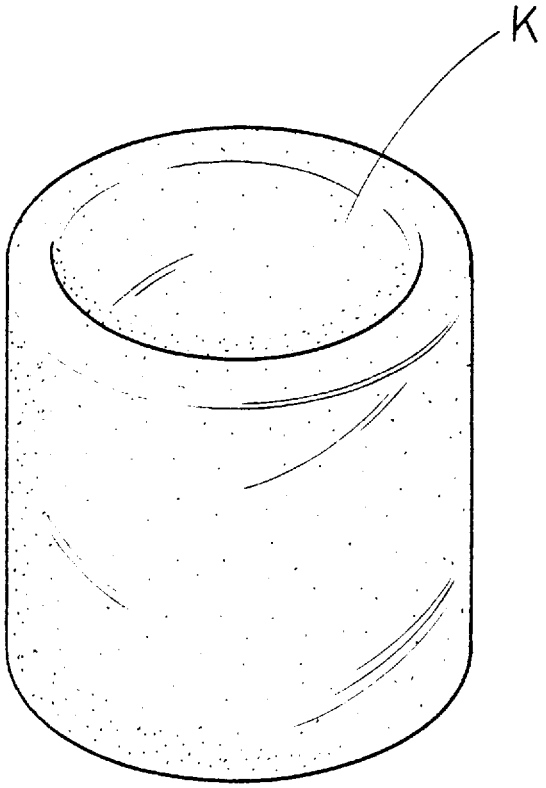
PRIOR ART FIG. 1
FIG. 1 is a perspective showing a conventional penholder.
Figure 2:
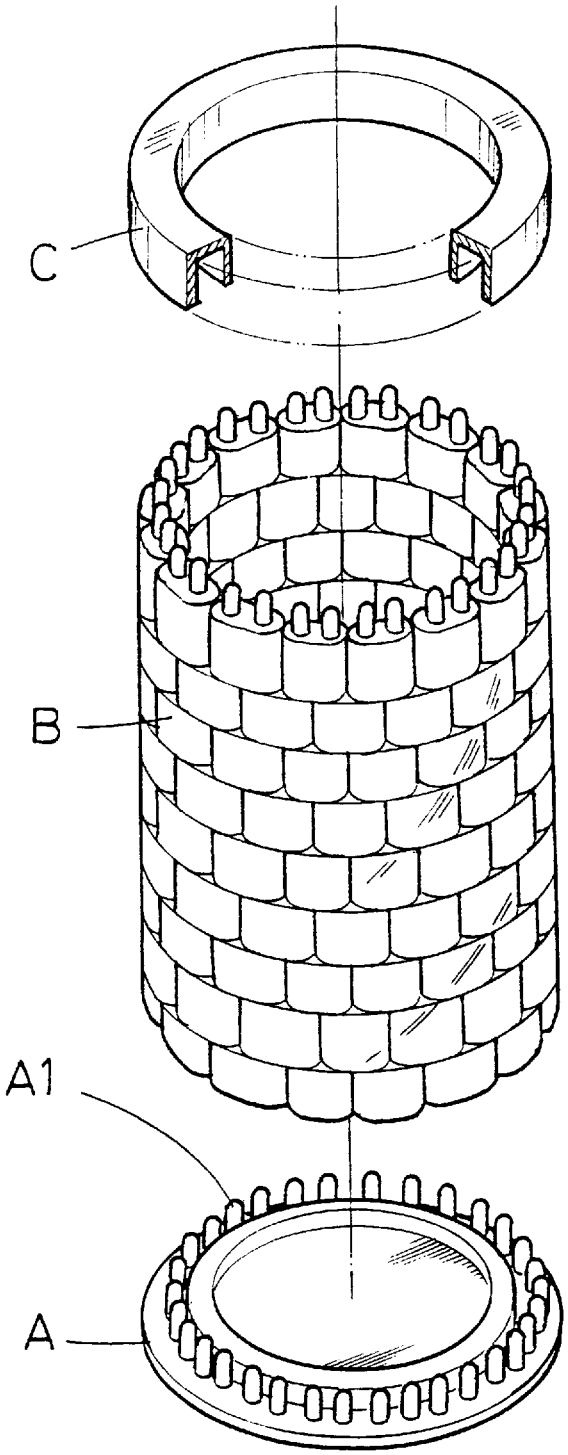
FIG. 2 is an exploded perspective of another conventional penholder.

The present invention relates to an improved shape-changeable sectional penholder which mainly includes a base 1, a multipurpose middle panel 2, a plurality of brick elements 3, a round cover 4, and a square cover 41.

Figure 3:
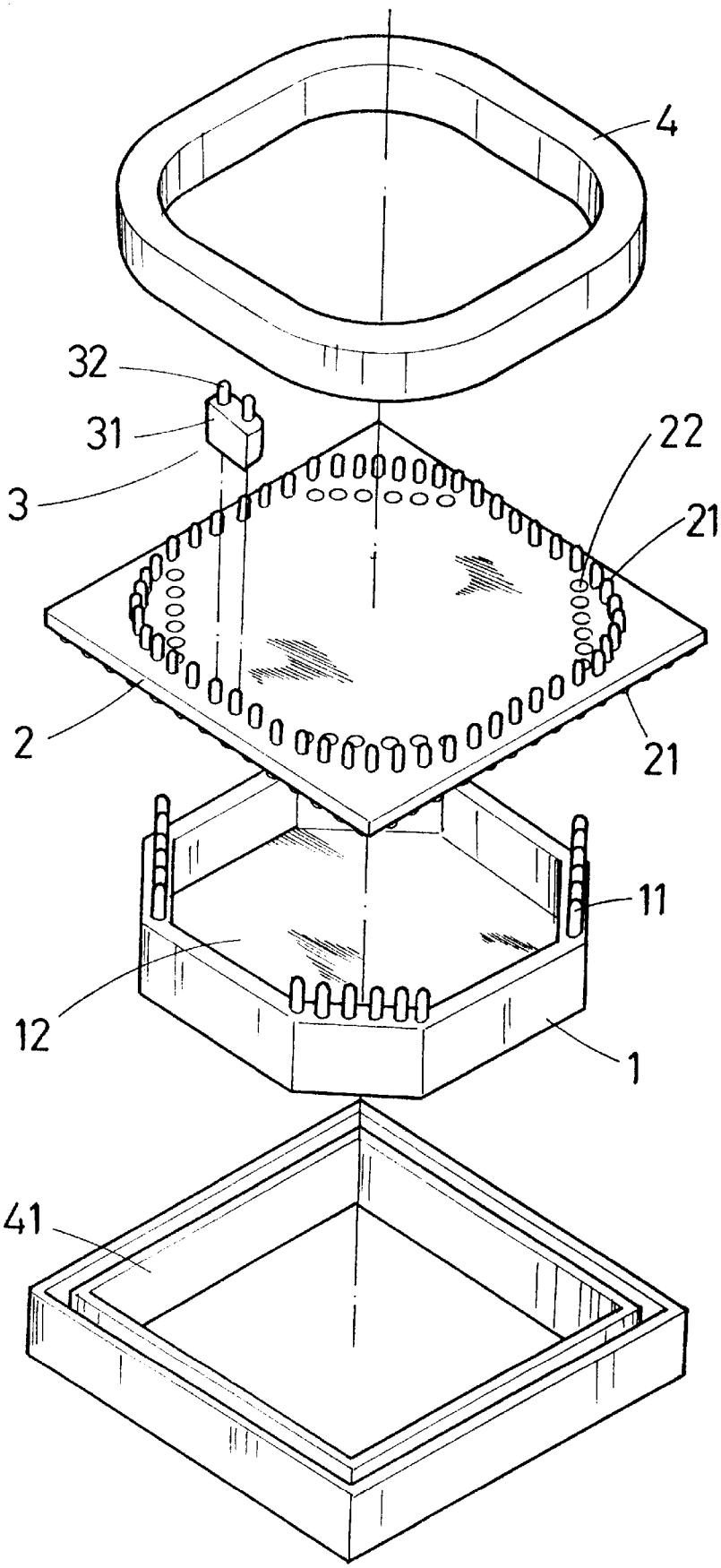
FIG. 3 is an exploded perspective of a sectional pensholder according to the present invention.

Please refer to FIG. 3. The base 1 is an octagonal-shaped member having a closed bottom and eight side walls which together define an inner space 12 and an upward opening.

A plurality of upward projected rods 11 are spaced on top edges of every other side walls of the base 1.

The multipurpose middle panel 2 is formed at two faces with a plurality of vertically projected rods 21. The rods 21 on a first face of the panel 2 are arranged to form a circle while the rods 21 on a second face of the panel 2 are arranged to form a square. A plurality of through holes 22 are formed on the panel 2 in number and at positions corresponding to the rods 11 upward projected from the base 1 to allow the rods 11 to extend therethrough.

The brick elements 3 each is formed at a top face with more than one projected rod 32. In a preferred embodiment as illustrated in FIG. 3, two projected rods 32 are formed on a brick element 3. The brick element 3 also has a side wall having a flat outer surface 31. Each brick element 3 is so designed that it can be engaged with the projected rods 21 of the multipurpose middle panel 2 and the projected rods 11 extending through the through holes 22.

The round cover 4 and the square cover 41 (not shown in FIG. 3) are so formed that they can match with the first and the second face of the middle panel 2, respectively.

When the penholder of the present invention is assembled with the first face of the middle panel 2 facing upward, the projected rods 21 forming a circle at the first face shall permit a round side wall to form. The formation of a round side wall is done by engaging the brick elements 3 with the rods 21 on the panel 2 to form a first layer of the side wall. Then, more brick elements 3 can be further superposed on the first layer of brick elements 3 to engage with the rods 32 thereof. In the same manner, more layers of engaged brick elements 3 can be formed until a desired or suitable height is reached. Then, the round cover 4 is closed to the top of the round side wall so formed. Any unused brick elements 3 can be put in the space 12 defined by the base 1 for future use before the base 1 is connected to the round side wall by extending the rods 11 of the base 1 into the through holes 22 of the middle panel 2. Finally, the square cover 41 is disposed beneath the base 1. A round sectional penholder is now completed.

Figure 4:
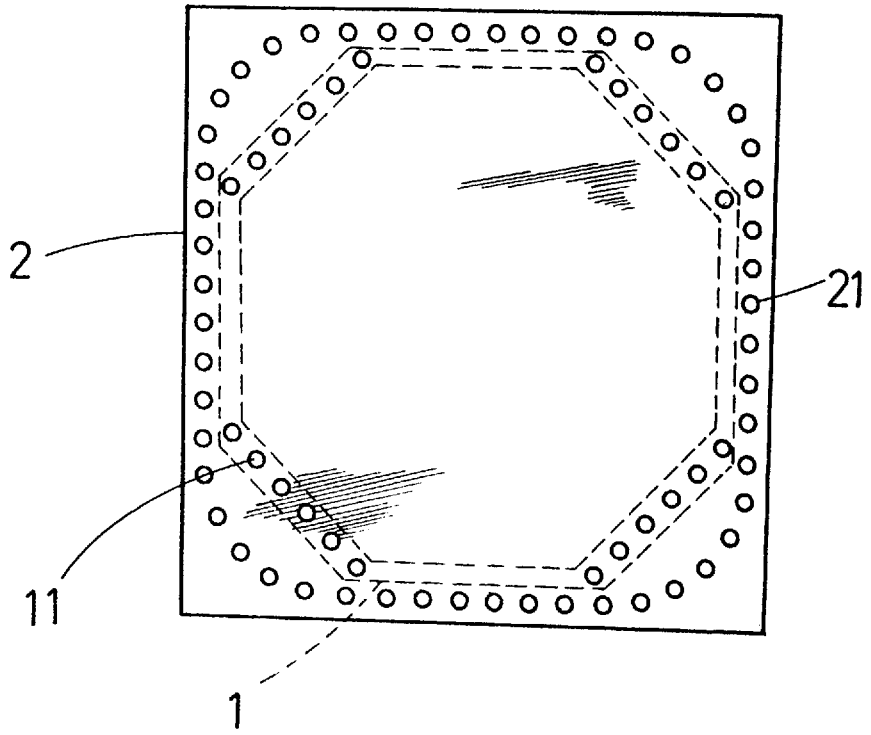
FIG. 4 is a top view of the multipurpose middle panel assembled to the base of the present invention with a first face of the middle panel facing upward.

Please refer to FIG. 4. Since the rods 11 of the base 1 have numbers and positions corresponding to that of the through holes 22 of the middle panel 2, and since the base 1 must be able to stably connect to the panel 2 within both the rod-formed circle and square on the first and the second face of the middle panel 2, a periphery defined by the side walls of the base 1 must be smaller than the circle defined by the rods 21 on the first side of the panel 2.

Figure 5:
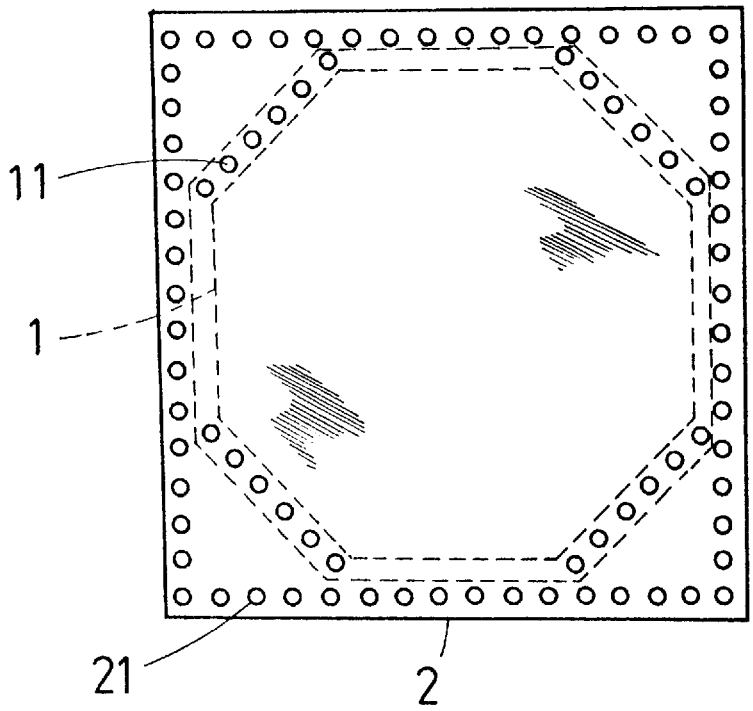
FIG. 5 is a top view of the multipurpose middle panel assembled to the base of the present invention with a second face of the middle panel facing upward.

FIG. 5 illustrates the middle panel 2 is assembled to the base 1 with its second face having the rod-formed square facing upward. In the same manner of superposing the brick elements 3 on the rods 21 of the panel 2 and on themselves as described with reference to FIG. 4. a sectional penholder with a square side wall can be formed. That is, with the rods 21 provided on two faces of the middle panel 2, either a round or a square sectional penholder can be formed at will. The extra brick elements 3 that are not in use can be stored in the space 12 of the base 1 without being carelessly discarded.

Figure 6:
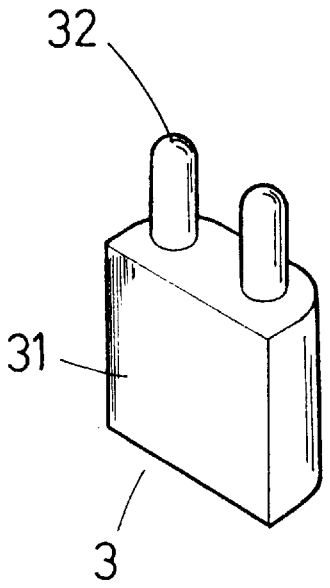
FIG. 6 is a perspective showing the brick element of the present invention.

As shown in FIG. 6, the brick element 3 is different from the conventional ones in the more than one projected rod 32 thereof and the one side wall with flat outer surface 31. The one flat outer surface 31 of the brick element 3 permits multiple assembled brick elements 3 to form a substantially smooth surface as large as possible which may prevent impurities from depositing on tiny gaps existed between the alternately superposed brick elements 3 while it provides the beauty of neatness and smoothness. To prevent any sharp edges formed on the penholder, the brick element 3 can be slightly chamfered at two corners where the flat outer surface 31 joints with another curved surface of the brick element.

Figure 7A:
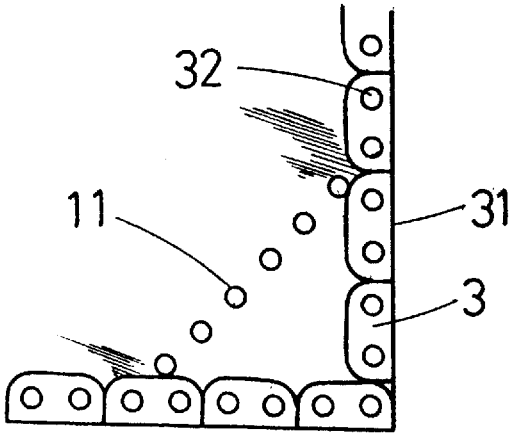
FIGS. 7A, 7B, and 7C illustrates three different arrangements of the brick elements available from the middle panel of the present invention.

Please refer to FIG. 7A. When a square penholder is to be formed, the second face of the middle panel 2 is turned upward, the brick elements 3 are superposed in the above-mentioned manner to form four side walls of the penholder. As shown, the side walls so formed have substantially flat and smooth surfaces.

Figure 7B:
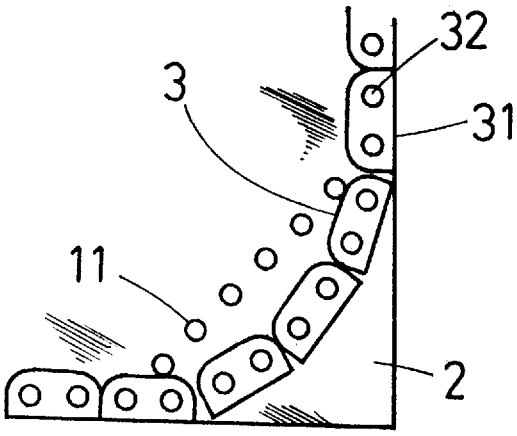

When a round penholder is desired, the first face of the middle panel 2 is turned upward, the brick elements 3 are similarly superposed, and a substantially round side wall is formed as shown in FIG. 7B.

Figure 7C:
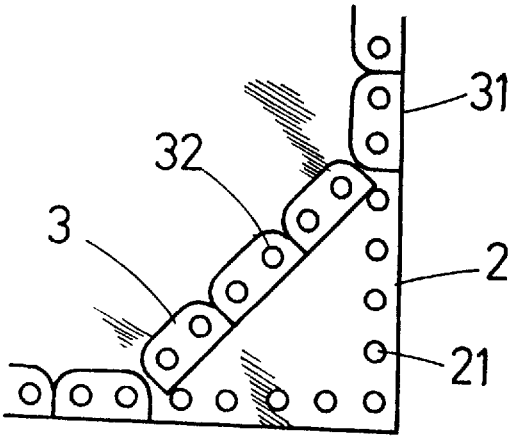
Figure 8:
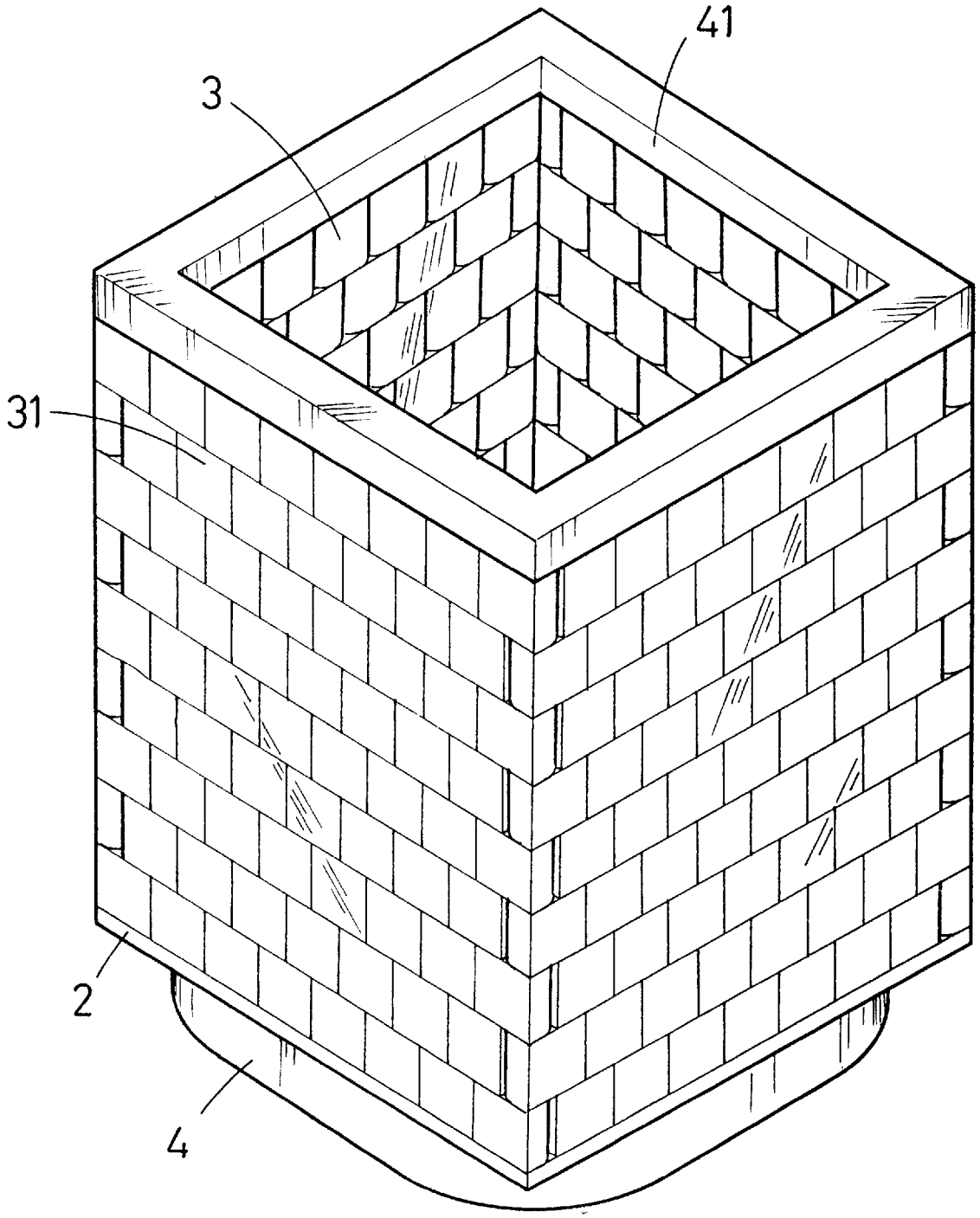
FIG. 8 is a perspective of a square penholder provided by the present invention.

The projected rod 11 has a length which permits the rod 11 to be as high as the projected rod 21 when the rod 11 extends through and projects from the through hole 22. With this arrangement, an octagonal penholder can be formed when the through holes 22 are utilized to superpose the brick elements 3 either on the first or the second face of the middle panel 2, as shown in FIG. 7C.

According to the above description, at least three different shapes of penholder can be formed from the assembly of the base 1 and the middle panel 2, namely, the round, the square or the octagonal penholder.

Figure 9:
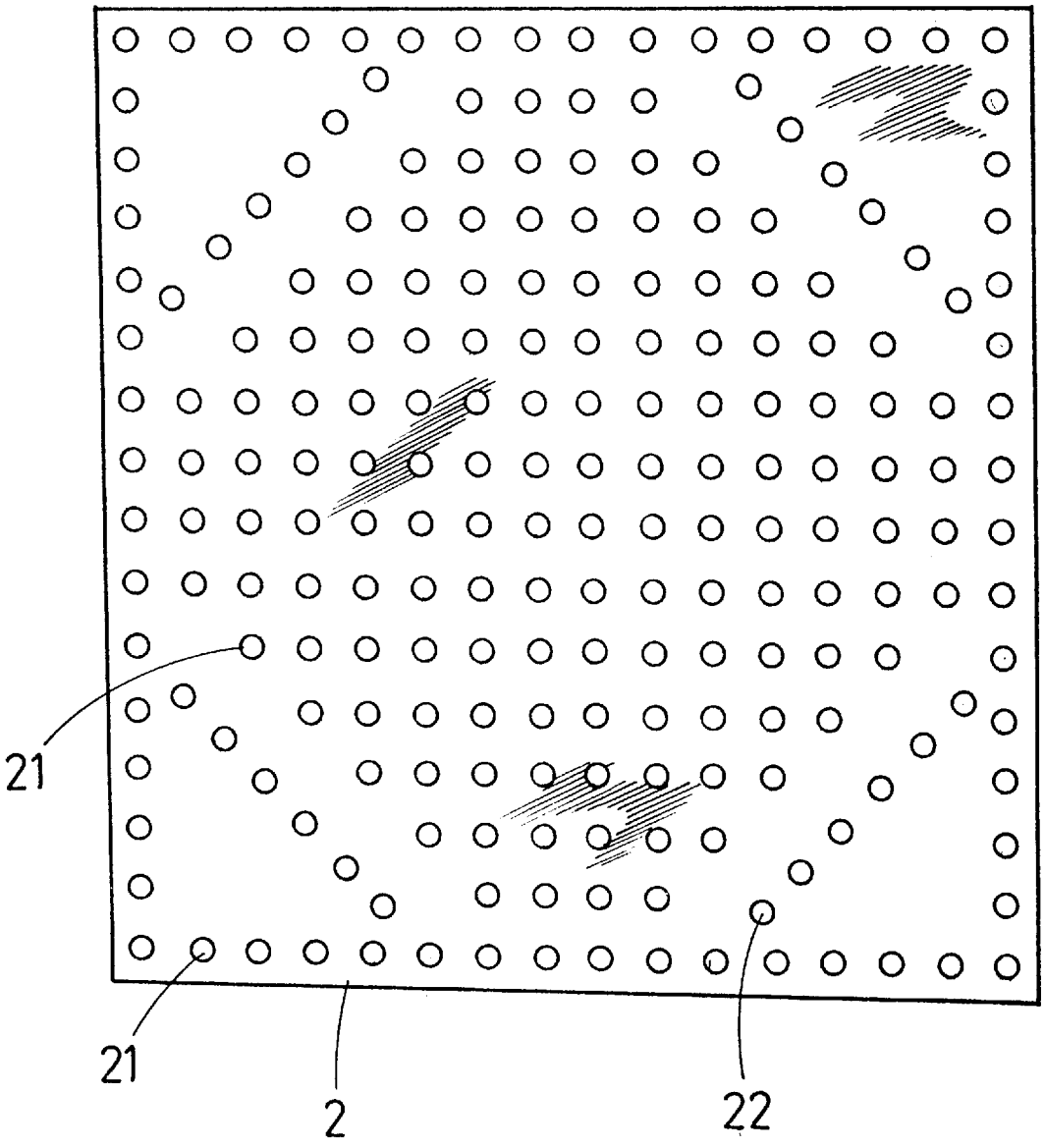
FIG. 9 is a top view of the multipurpose middle panel of the present invention.
Figure 10:
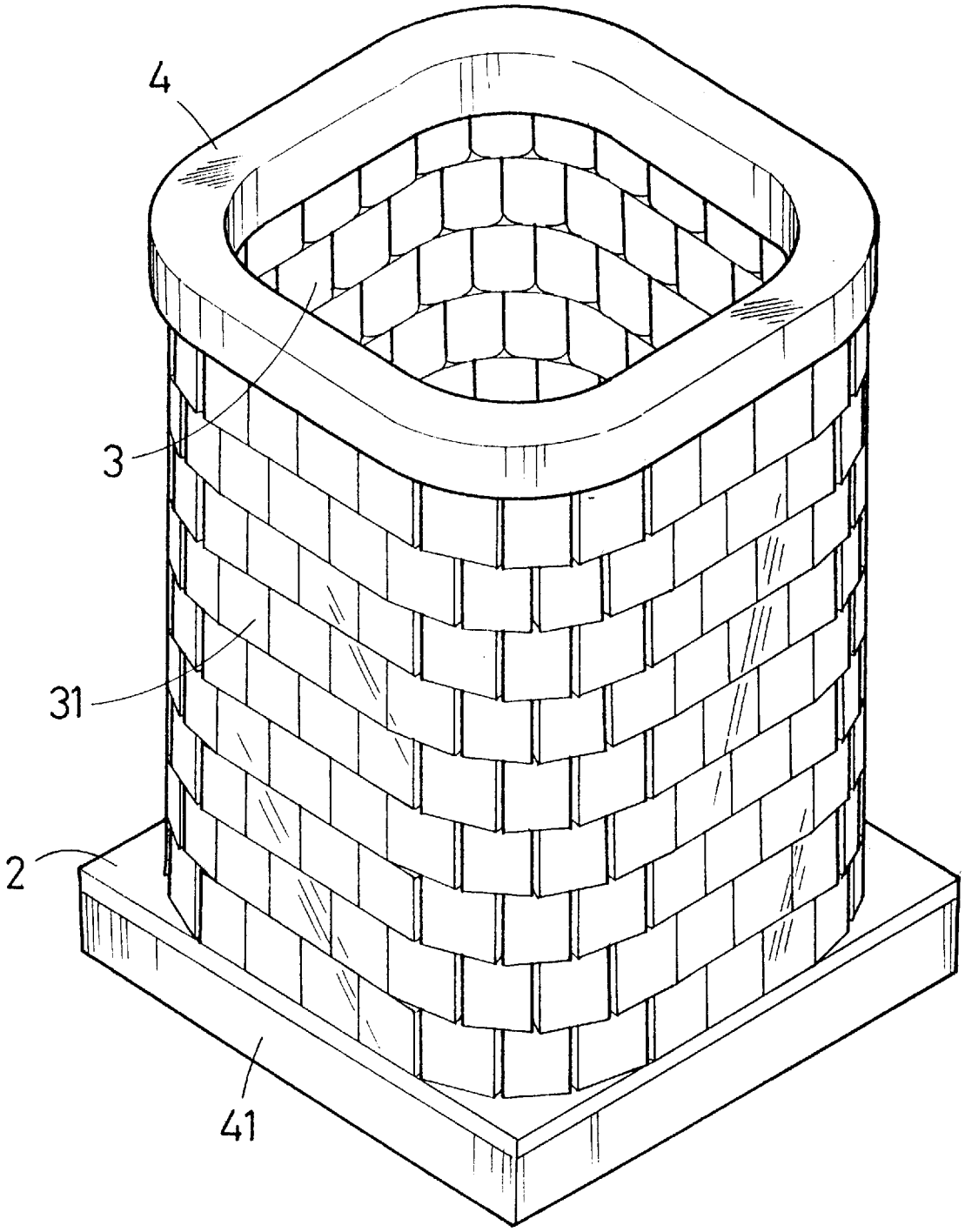
FIG. 10 another perspective of a round penholder provided by the present invention.
Figure 11:
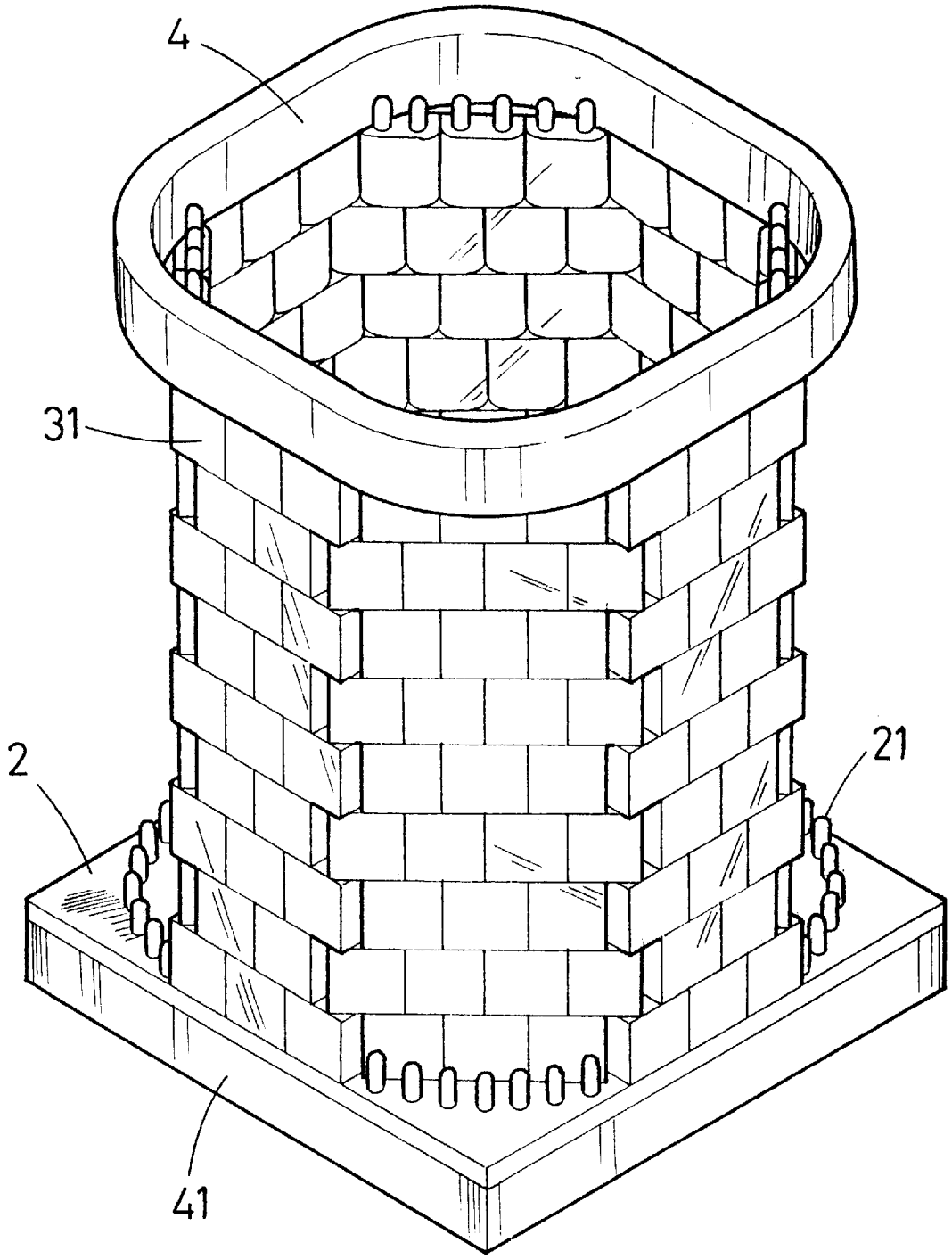
FIGS. 11, 12, and 13 illustrate other embodiments of the sectional penholder provided by the present invention.
Figure 12:
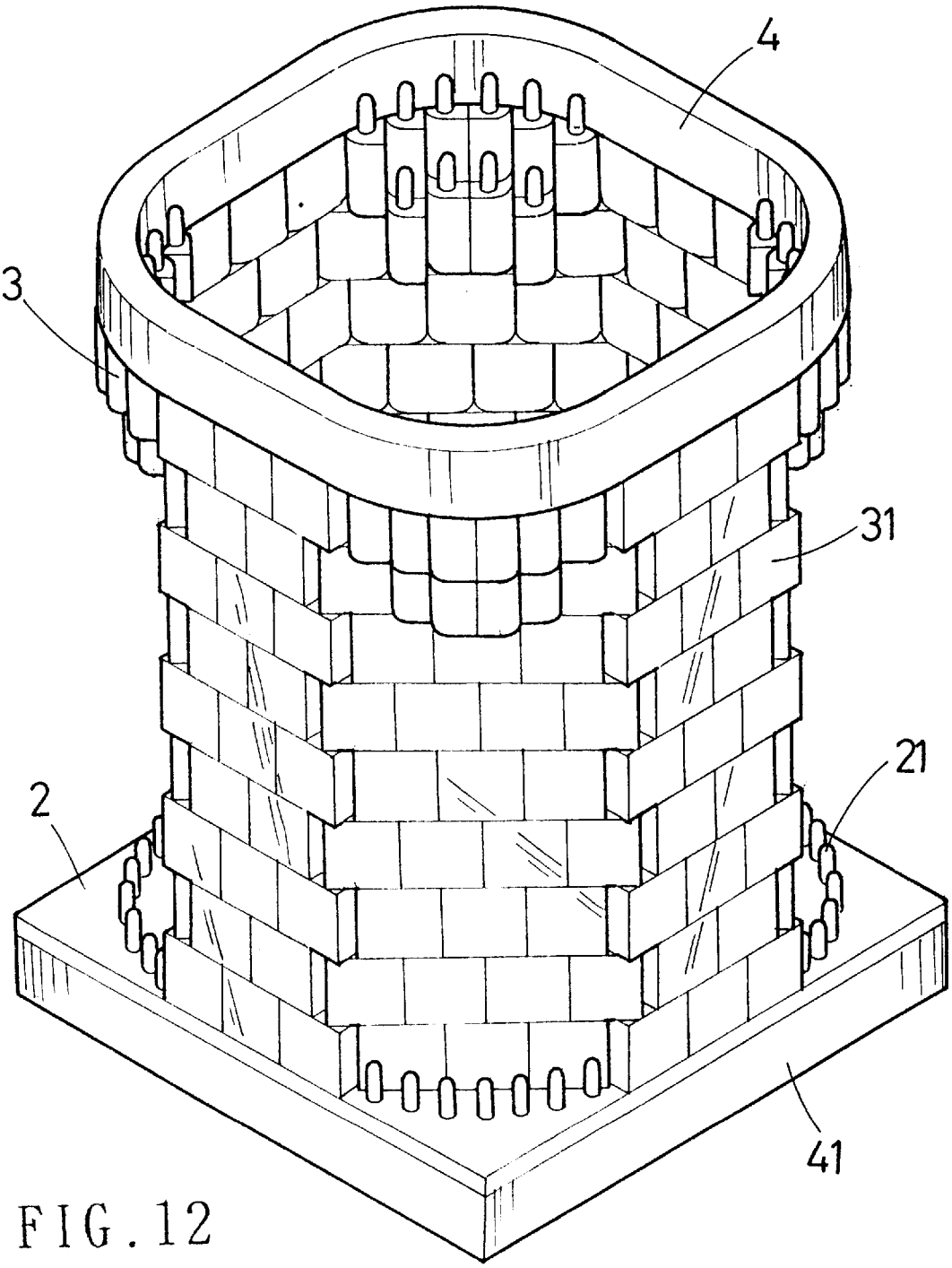
Figure 13:
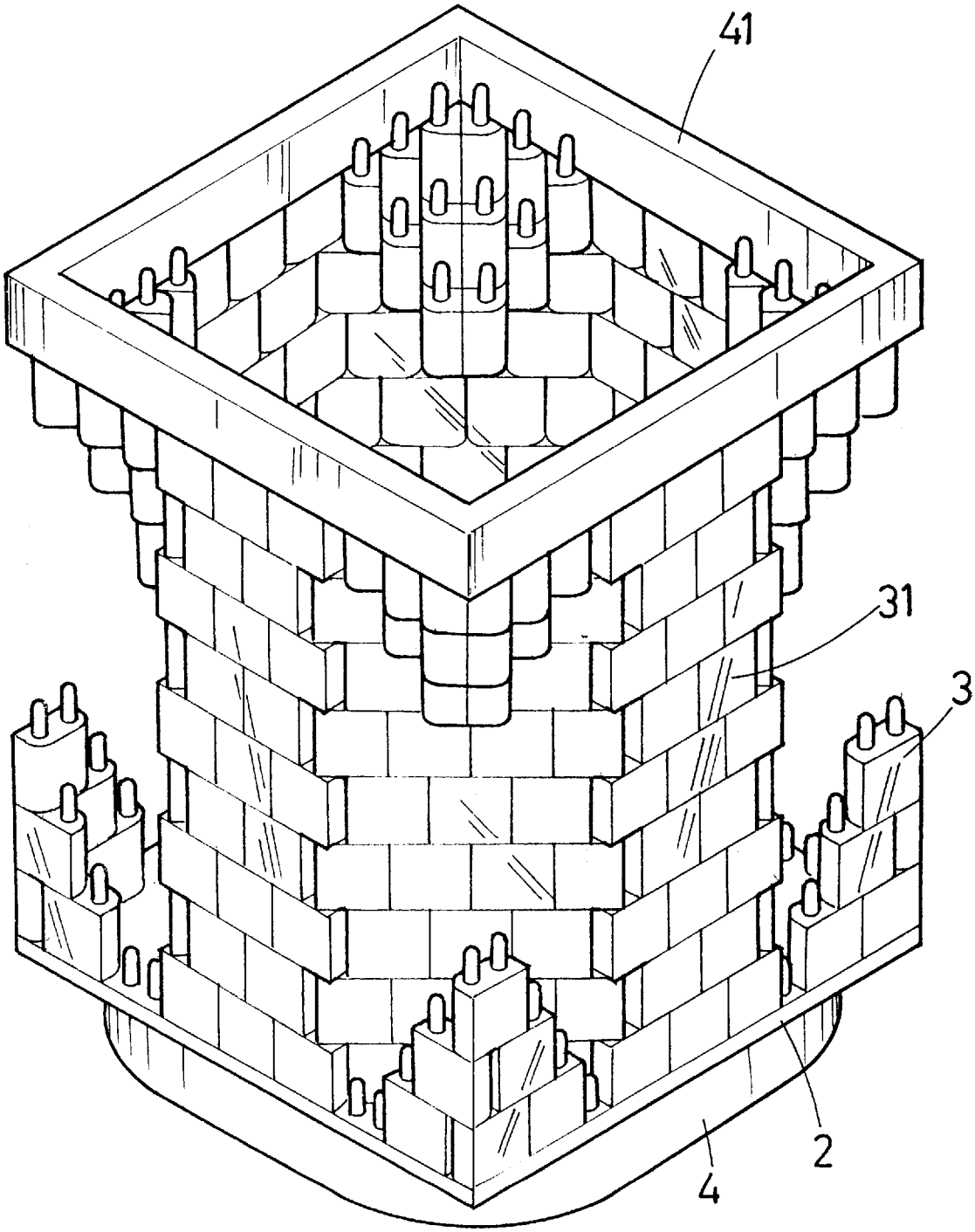

In another embodiment, projected rods 21 may also be formed on two faces of the middle panel 2 at central areas thereof, as shown in FIG. 9. These central rods 21 allow pens or other articles to be firmly inserted into spaces among them and therefore be firmly positioned in the penholder. Alternatively, other brick elements 3 may be superposed in this central area in any manner to create a new and unique desktop ornament.

What is claimed is:

1. A shape-changeable sectional penholder, comprising:

a base which is an octagonal-shaped member having a closed bottom and eight side walls which together defining an inner space and an upward opening, a plurality of upward projected rods being spaced on top edges of every other said side walls of said base;

a multipurpose middle panel being formed at two faces with a plurality of vertically projected rods, said rods on a first face of said panel being arranged to form a circle while said rods on a second face of said panel being arranged to form a square, said middle panel further being formed with a plurality of through hole in number and at positions corresponding to said rods upward projected from said base to allow said rods on said base to extend therethrough;

a plurality of brick elements each being formed at a top face with more than one projected rod and having a side wall which has a flat outer surface; and a round cover and a square cover having configurations corresponding to said circle and said square formed by said projected rods on said first and said second faces of said middle panel, respectively;

whereby a penholder is formed by superposing said brick elements on said projected rods on either face of said middle panel until a side wall with desired or suitable height is reached, closing said round or said square cover to a top of said side wall depending on the shape of a cross section of said side wall, and connecting said base to said middle panel by extending said projected rods on said base through said through holes on said middle panel.

2. A shape-changeable sectional penholder as claimed in claim 1, wherein said middle panel is disposed with said first face facing upward such that said side wall formed thereon has a round cross section.

3. A shape-changeable sectional penholder as claimed in claim 1, wherein said middle panel is disposed with said second face facing upward such that said side wall formed thereon has a square cross section.

4. A shape-changeable sectional penholder as claimed in claim 1, wherein said projected rods of said base have a length permitting them to be as high as said projected rods of said middle panel after they extend through and project from said through holes of said middle panel, such that an octagonal side wall can be formed when said through holes and a part of said projected rods on either face of said middle panel are utilized for said brick elements to be superposed on.

5. A shape-changeable sectional penholder as claimed in claim 1, wherein said octagonal base has an octagonal area smaller than said circle defined by said rods on said first face of said middle panel, such that either said round or said square cover can be disposed beneath and fitly engaged with said base when said cover is not used to close a top of said penholder.

6. A shape-changeable sectional penholder as claimed in claim 1, wherein said middle panel is formed on said first and said second faces at central areas thereof with a plurality of vertically projected rods for pens or other articles to stably insert therebetween or for said brick elements to superpose thereon to create any unique shape for use as a desktop ornament.

* * * * *